United States Patent [19]

Ruiz

[11] Patent Number: 4,634,183

[45] Date of Patent: Jan. 6, 1987

[54] TOILET CHAIRS

[75] Inventor: Robert Ruiz, Hempsted, England

[73] Assignee: James Industries Limited, Gloucester, England

[21] Appl. No.: 837,219

[22] Filed: Mar. 7, 1986

[30] Foreign Application Priority Data

Apr. 19, 1985 [GB] United Kingdom ..... 8510044

[51] Int. Cl.[4] ..... A47C 9/12

[52] U.S. Cl. ..... 297/433; 297/68

[58] Field of Search ..... 297/433, 434, 435, 436, 297/68

[56] References Cited

U.S. PATENT DOCUMENTS 2,278,678 3/1942 Kahn ..... 297/435

2,653,649 9/1953 Lindquist ..... 297/433 X 3,790,212 2/1974 Suyetani ..... 297/433

*Primary Examiner*—James T. McCall

*Attorney, Agent, or Firm*—Collard, Roe & Galgano, P.C.

[57] ABSTRACT

A toilet chair comprises a seat portion supported on a support frame. A footrest mounted on the frame is pivotable between an operative forwardly projecting position and a retracted position within the frame, and the frame is open at the rear to fit over and around a WC pan. The frame has a front cross member on which the footrest is pivotally mounted. Projections of the footrest engage the cross member to define the lowered operative position of the footrest and thus the cross member 12 provides stop means defining that position, in addition to being a structural member of the frame and forming a pivot shaft for the footrest.

9 Claims, 3 Drawing Figures

TOILET CHAIRS

BACKGROUND OF THE INVENTION

1. Field of the Invention

The invention relates to toilet chairs, particularly but not exclusively mobile toilet chairs, and particularly to base support frames thereof. It is especially concerned with toilet chairs the base support frames of which are open at the rear below an apertured seat so as to fit over and around a WC pan.

2. Description of the Prior Art

Such toilet chairs are commonly provided with a footrest which is pivotally mounted so that it can be moved inboard of the frame so that it is out of the way when not required. Firm mounting of the footrest is required and thus the provision of pivot mounting and stop means which define the operative position of the footrest adds considerably to the cost of the chair.

SUMMARY OF THE INVENTION

It is an object of the invention to provide a base support frame of a toilet chair with a footrest in a relatively simple and cost-effective manner.

According to the invention a toilet chair support frame which is open at the rear to fit over and around a WC pan has a front cross member at a lower level adjacent the front of the frame, which cross member performs the functions of a structural frame member, a pivot bar for a footrest pivotable between an operative forwardly projecting position and a retracted position within the frame, and stop means to define at least the operative position of the footrest.

Preferably the cross member is of circular cross-section to provide the pivot bar bearing surface and of generally U-shape, with the bottom limb of the U-shape providing the pivot bar and the side limbs thereof providing stops respectively engaged by laterally projecting stop members on the footrest to define the operative position of the latter.

The footrest may be formed from plate material with a main substantially flat portion providing a footrest surface and folded along its rear edge to a rectangular channel section which fits over and closely embraces the cross member. Mounting of the footrest on the cross member is then readily achieved by fixing one or more members to the bottom of the footrest which are so positioned as to retain the channel section of the latter on the cross member. The frame is conveniently of tubular steel construction with the ends of the cross member respectively welded to side members of the frame rearwardly of upstanding front members thereof which support the seat.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilizing the same or equivalent principles may be used and structural changes may be made as desired by those skilled in the art without departing from the present invention and the purview of the appended claims.

DESCRIPTION OF THE PREFERRED EMBODIMENT

Figure 1:
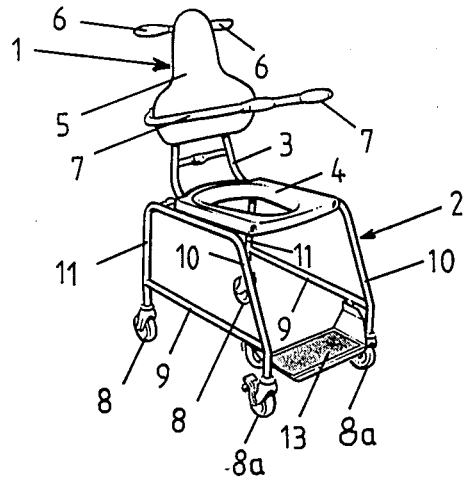
FIG. 1 is a perspective view of a toilet chair having a support frame in accordance with the invention.

The toilet chair illustrated comprises a seat portion 1 supported on a base frame portion 2. The seat portion 1 has its own frame 3 to which are attached an apertured seat 4 and a backrest 5. The tubular steel frame 3 has laterally projecting handgrips 6 which enable the chair to be propelled and maneuvered on rear wheels 8 and front braked castors **8*a* supporting the tubular steel frame 2. The frame 3 also has side support arms 7 either one of which can be pivoted rearwardly to provide access for side transfer of a user between the seat 4** and a wheelchair.

In this particular embodiment the seat portion 1 is detachable from the base support frame 2 to allow use of the portion 1 attached to an invalid hoist, for example for bathing purposes. The method of attachment to the support frame 2 is not described herein as it is not germane to the present invention and it will be appreciated that the seat portion 1 could be permanently attached to the frame 2 should this be desired. Furthermore the backrest 5 and support arms 7 could be omitted to provide a simple form of chair comprising the apertured seat 4 directly supported by and attached to the base frame 2.

Figure 2:
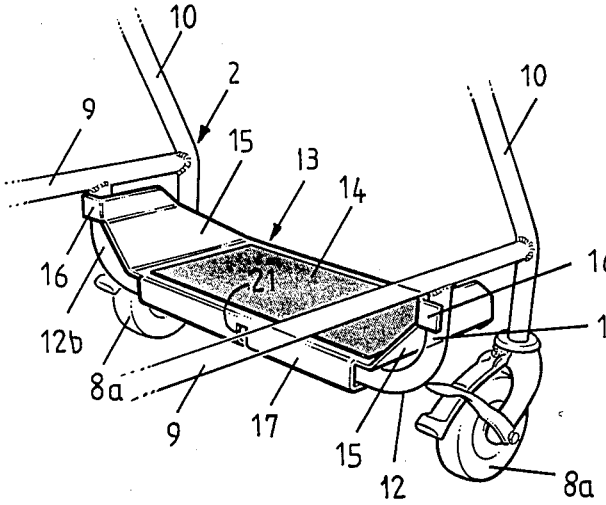
FIGS. 2 and 3 are detailed perspective views to a larger scale showing a footrest of the chair in an operative position and an inoperative position respectively.

The frame 2 comprises side members 9 fixed between respective upstanding front and rear members 10 and 11, between which the frame 2 is open at the rear to fit over and around a WC pan. A generally U-shaped cross member 12 is welded between the side members 9 rearwardly of the front members 10 so as to provide a structural member of the frame 2. The bottom limb **12*a* of the cross member 12 provides a pivot shaft on which a footrest 13 is pivotally mounted. The footrest 13 is formed from metal plate and in the operative position illustrated in FIGS. 1 and 2 is disposed generally horizontally and forwardly projecting between the front members 10 which, above the side members 9, are rearwardly inclined towards the seat 4. A foot-support pad 14 is secured to the upper surface of the footrest 13. The footrest 13 has upwardly and outwardly inclined side portions 15 which present laterally projecting ears 16 providing stop members which, as shown in FIG. 2, respectively engage behind the side limbs 12*b* of the cross member 12 to define the lowered inoperative position of the footrest 13. Thus the cross member 12 in addition to being a structural member of the frame 2 provides stop means defining the operative footrest position as well as forming the pivot shaft for the footrest 13**.

Along its rear edge the footrest 13, over the length of the straight portion of the limb **12*a*, is folded to provide a rectangular channel section 17 which fits on and closely embraces the cross member 12 on which the footrest 13 is retained by means of two spaced blocks 18. The blocks 18 are fixed to the bottom of the footrest 13**.

Figure 3:
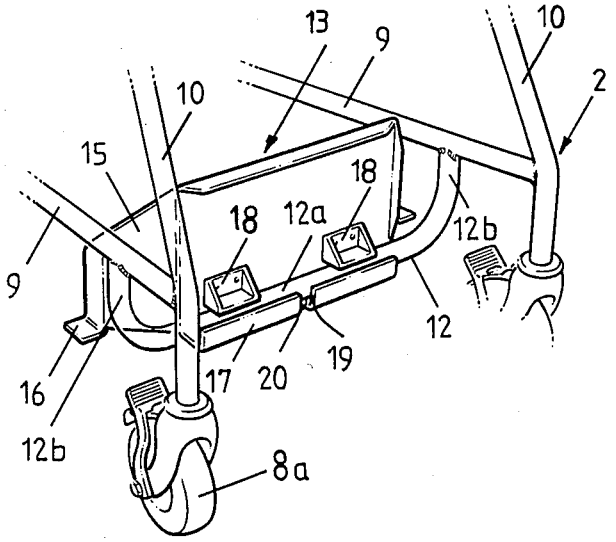

The rear channel section 17 of the footrest 13 has a centrally disposed cut-out slot 19 engaged by a downwardly projecting peg 20 fixed to the cross member 12. The engagement of the peg 20 in the slot 19 provides lateral location of the footrest 13 throughout the range of pivotal movement thereof and, in the inboard stowed position of the footrest 13 shown in FIG. 3, the peg 20 abuts the inner end 21 of the slot 19 to provide stop means defining that position of the footrest 13.

I claim:

1. A toilet chair comprising a support frame open at the rear to fit over and around a WC pan and a footrest pivotable between an operative forwardly projecting lowered position and a retracted position within said frame, said frame including a front cross member disposed at a lower level adjacent the front of the frame and forming a structural member of the frame, said footrest being pivotably mounted on said cross member for pivotal movement between said operative and retracted positions, and said footrest having stop means engageable with said cross member to limit said pivotal movement and thus to define said operative position of the footrest.

2. A toilet chair according to claim 1, wherein the frame is of tubular metal construction and said front cross member is of circular cross-section and provides a bearing surface for said pivotal movement of the footrest.

3. A toilet chair according to claim 1, wherein said cross member is of generally U-shaped configuration with a horizontal bottom limb providing a pivot bar on which said footrest pivots, and side limbs by which the cross member is secured in the frame and which are engageable by said stop means of the footrest to define said operative position thereof, said stop means of the footrest comprising laterally extending stop members on the footrest.

4. A toilet chair according to claim 3, wherein said frame comprises side members fixed between respective upstanding front and rear members of the frame, and said side limbs of the cross member are welded to said side members rearwardly of said front members.

5. A toilet chair according to claim 1, wherein said footrest is formed from plate material with a main substantially flat portion providing a footrest surface and a folded rectangular channel section along its rear edge which is integral with said flat portion, said channel section fitting over and closely embracing said cross member.

6. A toilet chair according to claim 5, wherein at least one member fixed to the bottom of said flat portion of the footrest is so positioned as to retain said channel section of the footrest pivotally engaged with the cross member.

7. A support frame according to claim 3, wherein said footrest is formed from plate material with a main substantially flat portion providing a footrest surface, with upwardly inclined side portions which present laterally projecting ears providing said stop members which respectively engage behind said side limbs of the cross member to define the lowered inoperative position of the footrest, and with a folded rectangular channel section along the rear edge of the footrest which fits over and closely embraces said cross member.

8. A support frame according to claim 5, wherein said rear channel section of the footrest has a cut-out slot engaged by a projection on the cross member, such engagement providing lateral location of the footrest and said projection abutting the inner end of the slot to provide stop means defining said retracted position of the footrest.

9. A toilet chair according to claim 1, wherein a seat portion of the chair is detachably secured to and supported by said support frame.

* * * * *